US006430529B1

(12) United States Patent
Huang

(10) Patent No.: US 6,430,529 B1
(45) Date of Patent: Aug. 6, 2002

(54) SYSTEM AND METHOD FOR EFFICIENT TIME-DOMAIN ALIASING CANCELLATION

(75) Inventor: Shay-Jan Huang, Milpitas, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 0 days.

(21) Appl. No.: 09/259,512

(22) Filed: Feb. 26, 1999

(51) Int. Cl.[7] ..... G10L 19/02

(52) U.S. Cl. ..... 704/229; 704/200.1; 704/204; 704/205; 704/500; 375/240; 708/402; 708/401; 708/400

(58) Field of Search ..... 704/229, 200.1, 704/230, 203, 204, 226, 500, 205, 225; 375/240; 708/402, 400, 401

(56) References Cited

U.S. PATENT DOCUMENTS

| | | | | |
|---|---|---|---|---|
| 5,230,038 A | | 7/1993 | Fielder et al. | |
| 5,297,236 A | * | 3/1994 | Antill et al. | 704/203 |
| 5,363,096 A | * | 11/1994 | Duhamel et al. | 341/50 |
| 5,727,119 A | * | 3/1998 | Davidson et al. | 704/203 |
| 5,781,888 A | * | 7/1998 | Herre | 704/219 |
| 5,857,000 A | | 1/1999 | Jar-Ferr et al. | |
| 5,890,106 A | * | 3/1999 | Bosi-Goldberg | 704/203 |
| 6,119,080 A | * | 9/2000 | Liu et al. | 704/203 |
| 6,119,038 A1 | * | 3/2001 | Tsutsui | 704/229 |
| 6,209,015 B1 | * | 3/2001 | Jhung | 708/402 |

FOREIGN PATENT DOCUMENTS

WO 9222137 10/1992 ..... H03H/17/02

OTHER PUBLICATIONS

Lau et al., ("A common transform engine for MPEG and AC3 audio decoder", IEEE transactions on Consumer Electronics, Jun. 1997, vol. 43, Issue 3, pp. 559–566).*

Vetterli et al., ("Split–radix algorithms for length–p/sup m/DFTs", 1988 International Conference on Acoustics, Speech, and Signal Processing, 1988, ICASSP–88, vol. 3, Apr. 1988, pp. 1415–1418).*

Duhamel("Algorithms meeting the lower bounds on the multiplicative complexity of Length–2n DFT's and their connection with practical algorithms", Transactions ICASSP–90, Sep. 1990, vol. 38, Issue 9, pp. 1504–1514).*

Jhung et al., ("Architecture of Dual mode audio filter for AC–3 and MPEG", IEEE Transactions on Consumer Electronics, vol. 43, Issue 3, Aug. 1997, pp. 575–585).*

(List continued on next page.)

*Primary Examiner*—Vijay B Chawan
(74) *Attorney, Agent, or Firm*—Gregory J. Koerner; Simon & Koerner LLP

(57) ABSTRACT

The invention comprises an efficient system and method for performing the modified discrete cosine transform (MDCT) in support of time-domain aliasing cancellation (TDAC) perceptive encoding compression of digital audio. In one embodiment, an AC-3 encoder performs a required time-domain to frequency-domain transformation via a MDCT. The AC-3 specification presents a non-optimized equation for calculating the MDCT. In one embodiment of the present invention, an MDCT transformer is utilized which produces the same results as carrying out the calculations directly as in the AC-3 equation, but requires substantially lower computational resources. Because the TDAC scheme requires MDCT calculations on differing block sizes, called the long and short blocks, one embodiment of the present invention utilizes complex-valued premultiplication and postmultiplication steps which prepare and arrange the data samples so that both the long and short block transforms may be computed with a computationally efficient FFT. The premultiplication and postmultiplication steps are carefully structured to work with FFT's in a manner which will give the same numeric results as would be achieved with a direct calculation of the MDCT.

9 Claims, 6 Drawing Sheets

OTHER PUBLICATIONS

Szu–Wei et al. "Transformation from 512–point transform coefficients to 256–point transform coefficients for Dolby AC–3 decoder" vol. 35, No. 19, 16/9/99, pp. 1614–1615.

Todd, Craig C. et al., "AC–3: Flexible Perceptual Coding for Audio Transmission and Storage," presented at Audio Engineering Society Convention, Amsterdam, Feb. 26—Mar. 1, 1994, pp. 1–16.

Advanced Television Systems Committee, "Digital Audio Compression Standard (AC–3)," ATSC Document A/52, Dec. 20, 1995, pp. 1–130.

* cited by examiner

SYSTEM AND METHOD FOR EFFICIENT TIME-DOMAIN ALIASING CANCELLATION

BACKGROUND OF THE INVENTION

1. Field of the Invention

This invention relates generally to improvements in digital audio processing, and relates specifically to a system and method for implementing an efficient time-domain aliasing cancellation in digital audio encoding.

2. Description of the Background Art

Digital audio is now in widespread use in digital video disk (DVD) players, digital satellite systems (DSS), and digital television (DTV). A problem in all of these systems is the limitation of either storage capacity or bandwidth, which may be viewed as two aspects of a common problem. In order to fit more digital audio in a storage device of limited storage capacity, or to transmit digital audio over a channel of limited bandwidth, some form of digital audio compression is required. One commonly used form of compression is perceptual encoding, where models based upon human hearing allow for removing information corresponding to sounds that will not be perceived by a human.

The Advanced Television Systems Committee (ATSC) selected the Dolby® Labs design for perceptual encoding for use in the Digital Television (DTV) system (formerly known as HDTV). This design is set forth in the Audio Compression version 3 (AC-3) specification ATSC A/52 (hereinafter "the AC-3 specification"), which is hereby incorporated by reference. The AC-3 specification has been subsequently selected for Region 1 (North American market) DVD and DSS broadcast.

The AC-3 specification gives a standard decoder design for digital audio, which allows all AC-3 encoded digital audio recordings to be reproduced by differing vendors' equipment. In contrast, the specifics of the AC-3 audio encoding process are not normative requirements of the AC-3 standard. Nevertheless, the encoder must produce a bitstream matching the syntax in the standard, which, when decoded, produces audio of sufficient quality for the intended application. Therefore, many of the encoder design details may be left to the individual designer without affecting the ability of the resulting encoded digital audio to be reproduced with the standard decoder design. It is usually more efficient to compress the audio data in the frequency domain rather than in the time domain. One way to perform the conversion from time domain to frequency domain is the modified discrete cosine transform (MDCT), which is one form of a discrete Fourier transform acting upon a function of a discrete variable. The MDCT is often used to convert input data sequences of discrete variables called time-domain data samples into output data sequences of discrete variables called frequency-domain coefficients. The time-domain data samples represent the measured values of the incoming audio data at discrete time values, and the frequency-domain coefficients represent the corresponding signal strengths at discrete frequency values.

In order to achieve high-fidelity audio when the encoded signals are later decoded during playback, the AC-3 specification adopted a method called time-domain aliasing cancellation (TDAC). The TDAC method may allow the near-perfect reconstruction of the original audio when encoded audio data is subsequently decoded for playback. The TDAC method includes two processes: a properly-chosen windowing operation using multiplication by windowing coefficients, followed by a MDCT.

An important design decision in a perceptual encoding standard is the number of digital samples transformed at a time in an MDCT, called the block-length of the MDCT. When transients (rapid fluctuations in values in a sequence of time-domain samples) are not observed, block switch flag blksw is set equal to 0, and an AC-3 encoder designed for TDAC switches to long-block MDCT calculations of 512 samples. When transients are observed, block switch flag blksw is set equal to 1, and the encoder switches to pairs of short-block MDCT calculations of 256 samples. A longer block-length increases frequency resolution but lowers time resolution. A longer block transform is usually adopted when the signal is relatively stable. A shorter block transform is adopted when the signal is relatively unstable to prevent pre-echoing effects. Therefore, rather than select a single MDCT block-length, an encoder designed for TDAC switches between MDCT block-lengths of 512 samples and 256 samples in order to maximize fidelity as audio circumstances require.

The AC-3 specification gives a basic equation for the calculation of the encoder MDCT. However, directly calculating the MDCT using the basic equation requires inordinate amounts of processor power, which prevents the implementation of an encoder with practical, cost-effective processing components. Optimizing the calculations for the MDCT for the different block-lengths is therefore an issue in the efficient design of AC-3 encoders.

SUMMARY OF THE INVENTION

The present invention includes a system and method for an efficient time-domain aliasing cancellation (TDAC) in digital audio encoding. In one embodiment, the present invention comprises an improved modified discrete cosine transform (MDCT) method for efficient perceptive encoding compression of digital audio in Dolby® Digital AC-3 format. In alternate embodiments, the improved MDCT method may be used in other perceptive encoding formats.

One embodiment of the present invention utilizes complex-valued premultiplication and complex-valued postmultiplication steps which prepare and arrange the data samples so that both the long-block and short-block transforms may be efficiently performed. The premultiplication and postmultiplication steps are carefully structured to work with discrete Fourier transforms (DFT) in a manner which will give the same numeric results as would be achieved with a direct calculation of the MDCT. However, the complex-valued premultiplication, DFT, and complex-valued postmultiplication steps together require many fewer calculation steps than the direct calculation of the MDCT. In this manner, the present invention facilitates the use of consumer-oriented digital signal processors (DSP) of reduced computational power, which in turn reduces the cost for practical implementations.

DETAILED DESCRIPTION OF THE PREFERRED EMBODIMENT

The present invention relates to an improvement in digital signal processing. The following description is presented to enable one of ordinary skill in the art to make and use the invention and is provided in the context of a patent application and its requirements. The present invention is specifically disclosed in the environment of digital audio perceptive encoding in Audio Compression version 3 (AC-3) format, performed in an encoder/decoder (CODEC) integrated circuit. However, the present invention may be practiced wherever time-domain aliasing cancellation (TDAC) is used to transform data from the time-domain to the frequency-domain. Various modifications to the disclosed embodiments will be readily apparent to those skilled in the art and the generic principles herein may be applied to other embodiments. Thus, the present invention is not intended to be limited to the embodiment shown, but is to be accorded the widest scope consistent with the principles and features described herein.

In one embodiment, the present invention comprises an efficient system and method for performing the modified discrete cosine transform (MDCT) in support of TDAC perceptive encoding compression of digital audio. Perceptive encoding uses experimentally-determined properties of human hearing to compress audio by removing information corresponding to sounds which are not perceived by the human ear. Typically the digital audio input data sequences of time-domain data samples are first converted to output data sequences of frequency-domain coefficients using some form of discrete Fourier transform. In one embodiment, an AC-3 encoder performs this conversion via an MDCT.

The AC-3 specification presents an equation for calculating the MDCT, but carrying out the calculations directly as specified in this equation requires excessive processing power. In one embodiment of the present invention, an MDCT transformer is utilized which produces the same results as when directly carrying out the calculations from the AC-3 equation. The MDCT transformer does this by a three-step process: a complex-valued premultiply step, a complex-valued fast Fourier transform (FFT) step, and a complex-valued postmultiply step. The complex-valued premultiply step arranges the incoming digital audio samples to match the input requirements of a very efficient complex-valued FFT. After performing the FFT, the complex-valued postmultiply step converts the output of the FFT so that, when the real and imaginary parts are separated, they correspond exactly to the result of direct calculation using the AC-3 specification equation.

Figure 1:
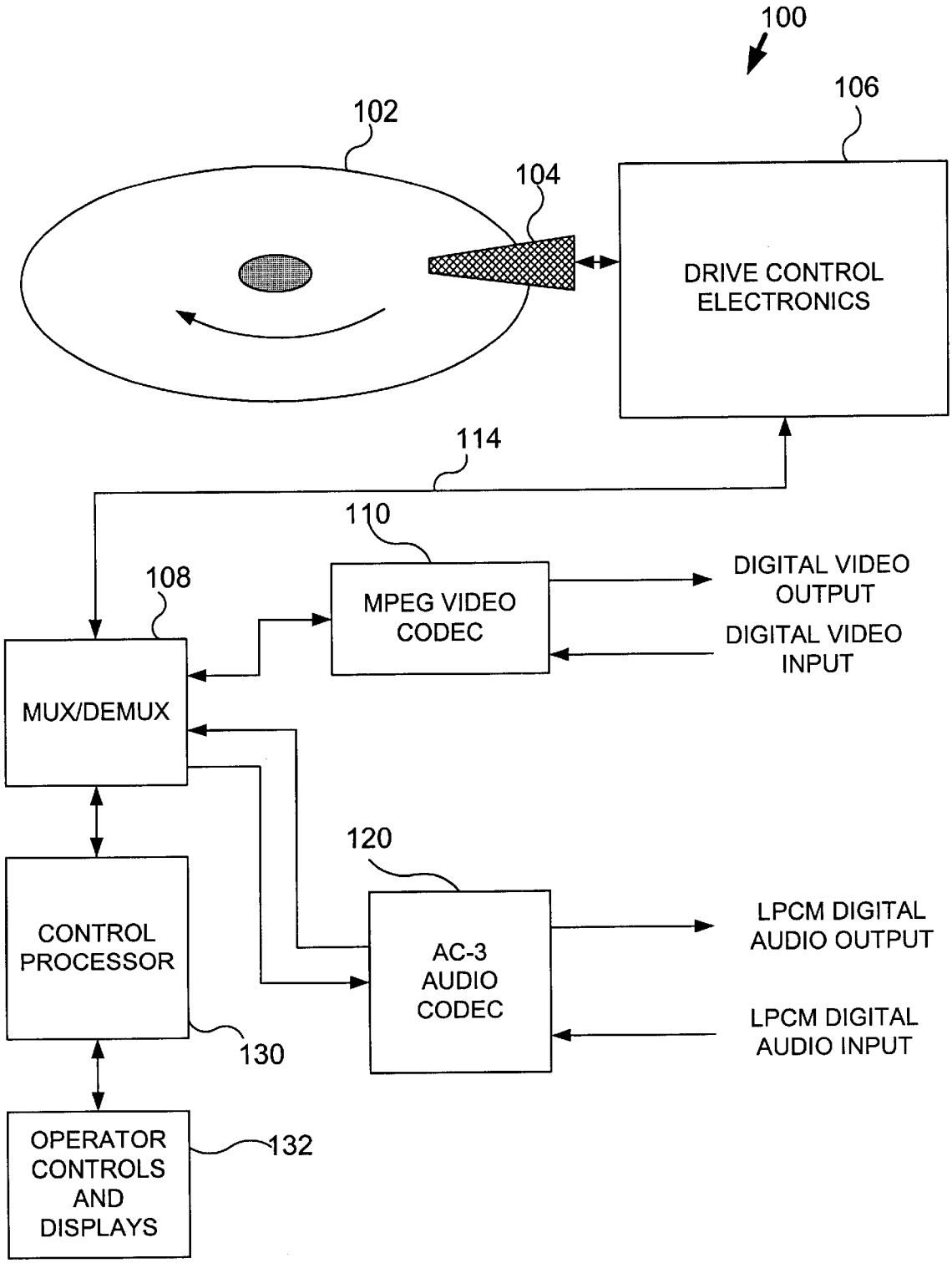
FIG. 1 is a block diagram for one embodiment of a read/write DVD player, in accordance with the present invention.

Referring now to FIG. 1, a block diagram for one embodiment of a read/write DVD player 100 is shown, in accordance with the present invention. In one embodiment, read/write DVD player 100 includes DVD 102, head-arm assembly 104, drive control electronics 106, multiplexor/demultiplexor 108, Motion Picture Experts Group (MPEG) video CODEC 110, AC-3 audio CODEC 120, control processor 130, and operator controls and displays 132. In one embodiment, DVD 102 is an optical disk platter which contains digital representations of audio and video information. DVD 102 rotates in DVD player 100, and the audio and video data on DVD 102 is read by head-arm assembly 104 under control of drive control electronics 106. Drive control electronics 106 extracts a combined audio and video digital bitstream from the information read by head-arm assembly 104 and sends the combined digital bitstream to multiplexor/demultiplexor 108.

Multiplexor/demultiplexor 108 separates the audio and video bitstreams from the combined digital bitstream entering on signal line 114. The video bitstream, preferably in MPEG-2 format, is sent for processing by MPEG video CODEC 110. When video from the DVD is decoded, it is then put into analog format and sent for display on an external video monitor. Video input from external sources is encoded by MPEG video CODEC 110, and then is sent via multiplexor/demultiplexor 108 to be written on DVD 102.

In one embodiment of the present invention, the format for the audio data encoded in the combined digital bitstream on signal line 114 entering multiplexor/demultiplexor 108 is AC-3 audio data. The audio data going to and from DVD 102 on signal line 114 preferably contains AC-3 audio data with 6 distinct channels of audio: 5 full bandwidth (fbw) channels and 1 low frequency effects (lfe) channel.

When DVD 102 is being played back, the AC-3 CODEC 120 receives AC-3 audio data from multiplexor/demultiplexor 108 and decodes it to produce linear pulse-code-modulated (LPCM) audio data. The LPCM data may then be converted to analog signals for reproducing via an audio system containing amplifiers and loudspeakers.

When DVD 102 is being recorded, the AC-3 CODEC 120 receives incoming LPCM data and encodes it in AC-3 format. This encoding process is described in detail in the description of FIG. 2 below.

Figure 2:
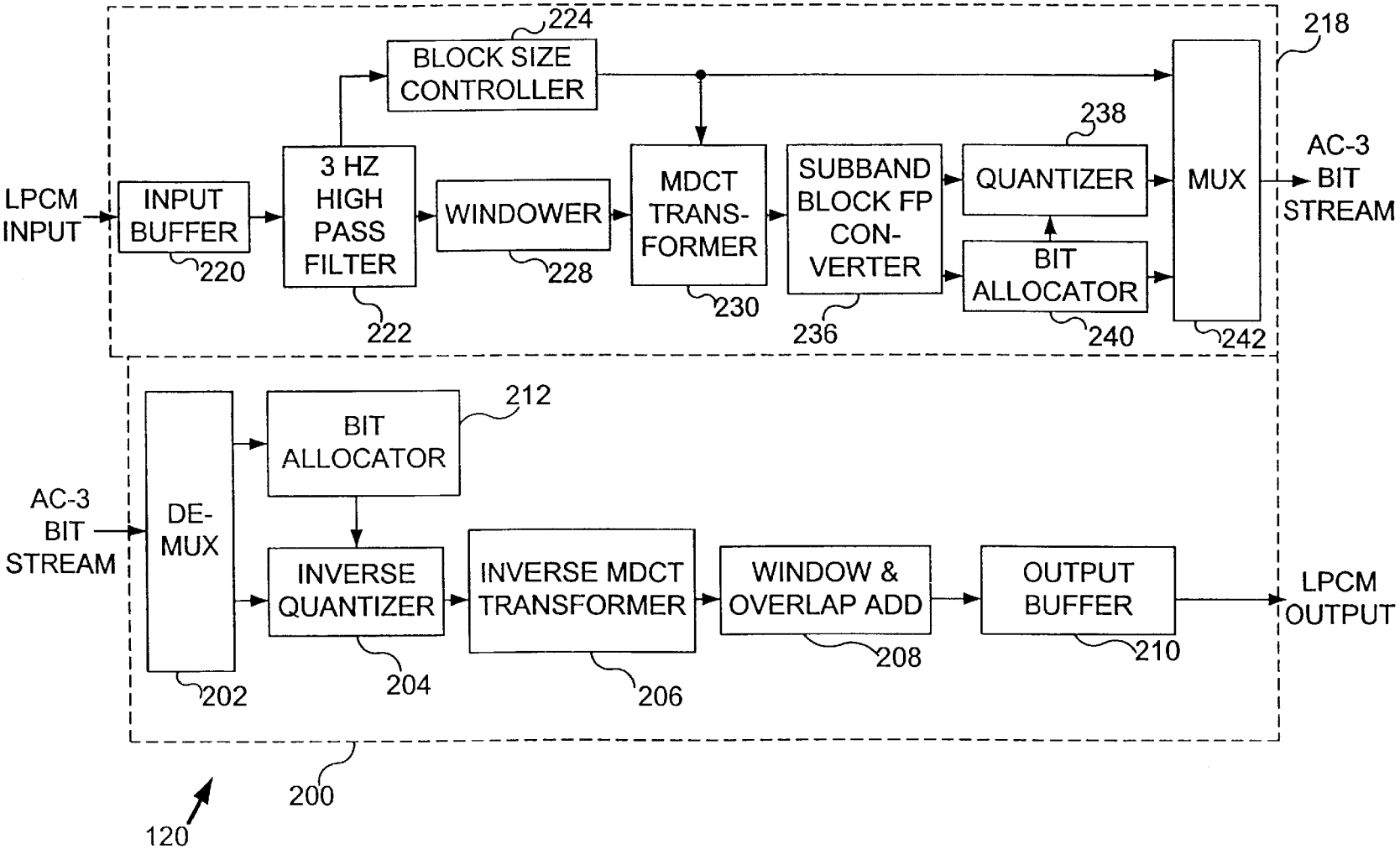
FIG. 2 is a block diagram for one embodiment of the AC-3 encoder/decoder (CODEC) of FIG. 1, in accordance with the present invention.

Referring now to FIG. 2, a block diagram for one embodiment of an AC-3 CODEC 120 of FIG. 1 is shown, in accordance with the present invention. In one embodiment, AC-3 CODEC 120 comprises AC-3 decoder 200 and AC-3 encoder 218.

The detailed design of AC-3 decoder 200 is disclosed in detail in the AC-3 specification that has been incorporated herein by reference. Briefly, in the FIG. 2 embodiment, the incoming multi-channel AC-3 bitstream enters demux 202 which buffers the bitstream data an entire frame at a time, where each frame may encompass a compressed representation of 256 frequency-domain coefficients per channel for up to 6 discrete channels of digital audio. Demux 202 separates compressed frequency-domain coefficients (audio data) from compression control data. The bit allocator 212 uses the compression control data to determine how to decompress the compressed frequency-domain coefficients. This decompression is performed by the inverse quantizer 204, which sends uncompressed frequency-domain coefficients to inverse modified-discrete-cosine-transform (MDCT) transformer 206. Inverse MDCT transformer 206 and window and overlap add 208 together convert the frequency-domain coefficients to time-domain samples. The time-domain samples are then arranged for transmission by output buffer 210.

AC-3 encoder 218 is not described in detail in the AC-3 specification. A general description and algorithm are given, with details presented only when necessary to ensure the output AC-3 bitstream will be reliably decoded by the standard AC-3 decoder 200. In one embodiment of the present invention, the major circuit blocks of AC-3 encoder 218 include input buffer 220, 3 Hz high pass filter 222, block size controller 224, windower 228, MDCT transformer 230, subband block floating point (FP) converter 236, quantizer 238, bit allocator 240, and multiplexor 242.

Input buffer 220 stores incoming blocks of LPCM digital audio data, and 3 Hz high pass filter 222 filters the data at cutoff frequency 3 Hz. Block size controller 224 determines transient content (the amount of rapid fluctuations in values in a sequence of time-domain samples) to support time-domain aliasing cancellation (TDAC) performed in windower 228 and MDCT transformer 230. When sufficient transient content is determined, block size controller 224 sets block switch flag blksw to 1 and thereby commands MDCT transformer 230 to transform a pair of short blocks rather than an individual long block.

The digital samples are sent by input buffer 220 through 3 Hz high pass filter 222 and windower 228. Windower 228 multiplies the incoming block of digital samples by the Fielder's window (given in the AC-3 specification) to reduce transform boundary effects and to improve frequency selectivity. After the windowing in the windower 228, the digital samples are ready for time-domain to frequency-domain transformation in MDCT transformer 230.

The AC-3 specification gives the following mathematical descriptions of the required MDCT.

Equation 1A for long-block transforms:

$$X_D[k] = \frac{-1}{N}\sum_{n=0}^{2N-1} x[n]\cos\left(\frac{\pi}{4N}(2n+1)(2k+1)+\frac{\pi}{4}(2k+1)\right)$$

where $0 \leqq k < N$.

Equation 1B for short-block transforms:

$$X_D[k] = \frac{-2}{N}\sum_{n=0}^{N-1} x[n]\cos\left(\frac{2\pi}{4N}(2n+1)(2k+1)+\frac{\pi}{4}(2k+1)(1+\alpha)\right)$$

where $0 \leqq k < N/2$, $\alpha=-1$ for the first short-block transform, and $\alpha=+1$ for the second short-block transform.

The transforms of Equation 1A and Equation 1B convert the windowed time-domain samples x[n] into frequency-domain coefficients $X_D[k]$. In the Equation 1A and Equation 1B transformations, N equals 256 for both a long-block and a short-block transform. It should be noted that there are half as many frequency-domain coefficients as there are time-domain samples.

It is possible, but very inefficient, to directly calculate the sequence $X_D[k]$ by performing all of the indicated operations in Equation 1A or Equation 1B. Such a direct calculation of Equation 1A or Equation 1B has computational complexity of order $N^2$, written $O(N^2)$. In one embodiment of the present invention, intermediate sequences Z[p] and z[q] are calculated. In this manner the overall calculation of the sequence $X_D[k]$ is reduced in computational complexity to $O(N\log_2 N)$. A complex-valued premultiplication step performs the conversion from x[n] to Z[p]. A DFT, which may be implemented as a fast Fourier transform (FFT), converts Z[p] to z[q]. Finally, a complex-valued postmultiply step converts z[q] to $X_D[k]$. Details of these three steps are given in the discussion of FIG. 4 below.

After MDCT transformer 230 completes the transformation of the time-domain samples into frequency-domain coefficients, the subband block floating-point (FP) converter 236 converts the frequency-domain coefficients into floating-point representation. This floating-point representation includes exponents and mantissas. Subband block FP converter 236 sends the exponents to bit allocator 240 and sends the mantissas to quantizer 238 to be quantized based on the outputs from bit allocator 240. Bit allocator 240 and quantizer 238 perform the actual data compression by allocating data bits only to those sounds which exceed the masking functions, and by quantizing the data to a finite number of bits. This eliminates the allocation of data bits to sounds which would not be perceived by a human listener. Compression is further enhanced by quantization to the maximum level where quantization error cannot be perceived by a human listener. Once the frequency-domain coefficients have been compressed, they are sent to multiplexor 242 for packing into AC-3 frames. The completed AC-3 frames exit encoder 218 from multiplexor 242.

Figure 3:
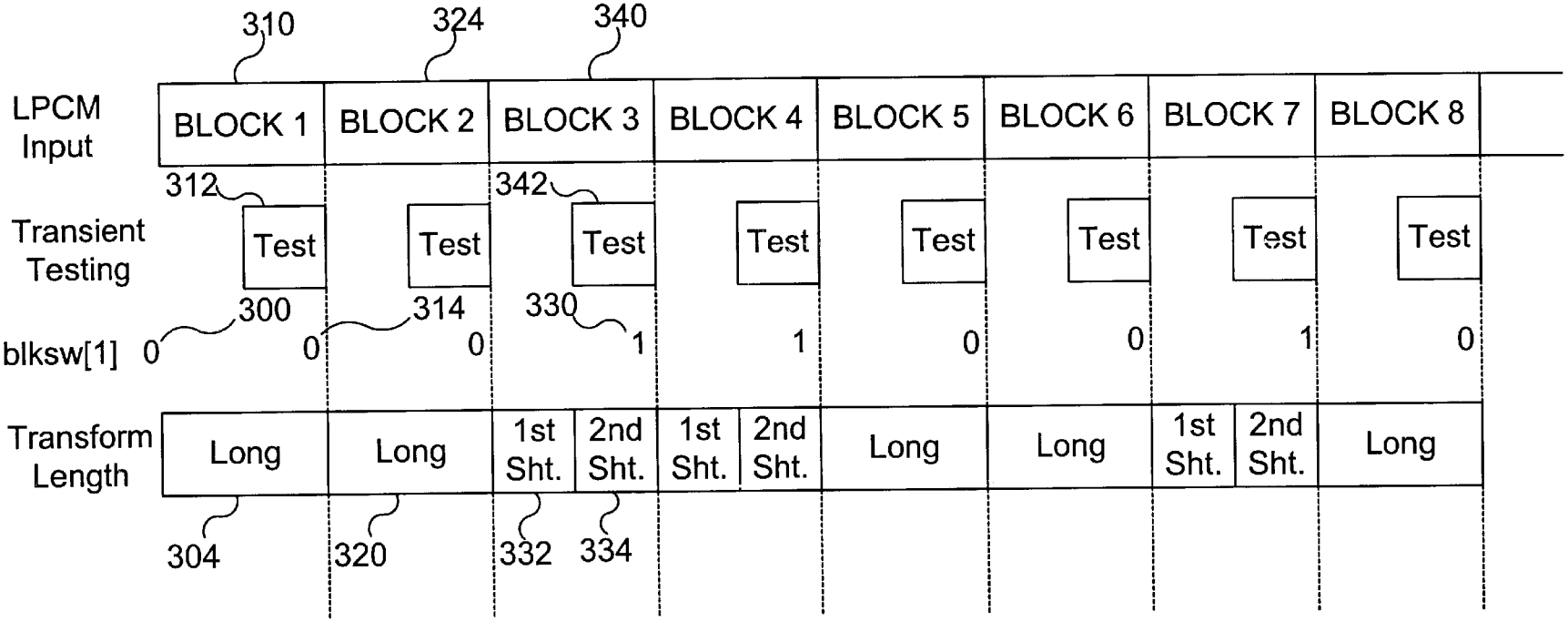
FIG. 3 is a timing diagram for one embodiment of sample transformation and time-domain aliasing cancellation, in accordance with the present invention.

Referring now to FIG. 3, a timing diagram for one embodiment of sample transformation and time-domain aliasing cancellation is shown, in accordance with the present invention. In one embodiment, six independent channels of digital audio arrive in LPCM format. For the purpose of illustration, FIG. 3 shows only a sequence of digital data corresponding to channel 1. Each numbered block shown contains 512 digital audio samples. In one embodiment with six independent channels, the channel 1 blocks of FIG. 3 are interleaved with blocks representing the other channels (not shown).

In the FIG. 3 example, block size controller 224 utilizes several criteria to determine if the transient content is sufficiently high. In one of these criteria, block size controller 224 tests for transient content in the second half of a block. If the results of the various criteria determine that the transient content is sufficiently high, blksw[1] is set to a 1. In the FIG. 3 example, the transient content of block 1 (310) is not determined to be sufficiently high, so blksw[1] is set equal to 0 (314). The MDCT transformer 230 therefore implements a long transform 304 for current block 1 (310). A similar process occurs during block 2 (324).

During block 3 (340) block size controller 224 determines the transient content is sufficiently high, and therefore blksw [1] is set to 1 (330). Upon reading blksw[1] set equal to 1 (330), MDCT transformer 230 implements a pair of short transforms 332, 324 for current block 3 (340).

In subsequent blocks, block size controller 224 continues to test the buffered blocks for transient content and sets the blksw[1] flag accordingly. In this manner, the lengths of the transform blocks are constantly adjusted in near-real-time to reduce pre-echoing effects, which would occur if improper block lengths were chosen.

Figure 4A:
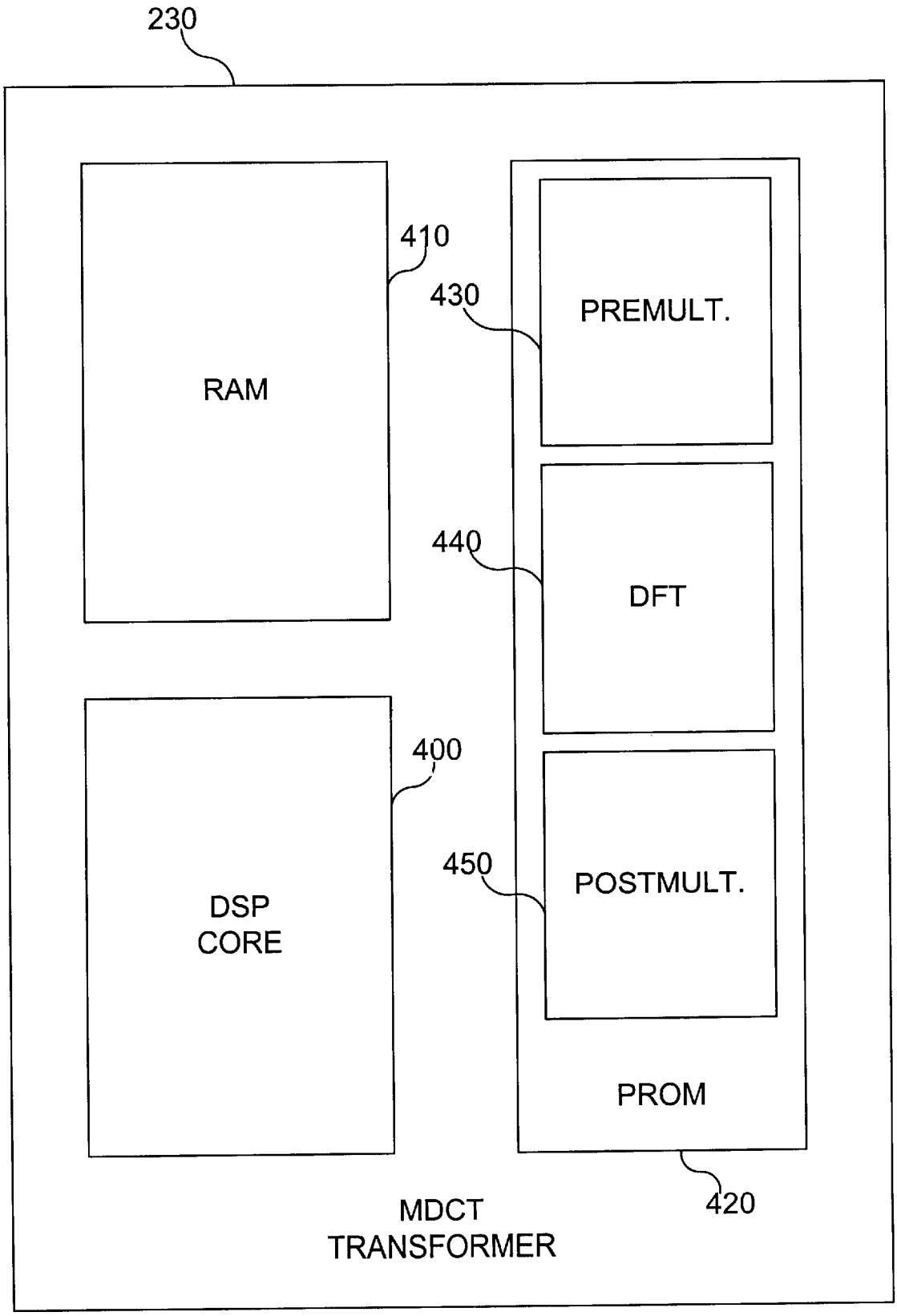
FIG. 4A is a block diagram for one embodiment of the fast computational modified discrete cosine transformer of FIG. 2, in accordance with the present invention.

Referring now to FIG. 4A, a block diagram for one embodiment of the fast computational modified discrete cosine transform (MDCT) transformer 230 of FIG. 2 is shown, in accordance with the present invention. The FIG. 4A MDCT transformer 230 includes digital signal processor (DSP) core 400, read/write random access memory (RAM) 410, and programmable read-only memory (PROM) 420. In one embodiment, three software modules are executed by DSP core 400 to control the three-step process for efficient implementation of the MDCT transform for TDAC. These modules are premultiplier 430, DFT 440, and postmultiplier 450. In the FIG. 4A embodiment, premultiplier 430 multiplies and arranges the digital audio samples so that they may be transformed by DFT 440. After DFT 440 transforms the data emerging from premultiplier 430, postmultiplier 450 then arranges the data emerging from DFT 440 so that it is equal to the data emerging from a direct calculation of Equations 1A and 1B above, and so that it is compatible with a standard AC-3 decoder.

An outline of the principle steps in premultiplier 430, DFT 440, and postmultiplier 450 is given below in pseudo-code. Pseudo-code is source code written in a generic programming language for the purpose of illustration, but which is not intended necessarily to compile on any particular compiler. For the purpose of illustration the pseudo-code adopts the format and definitions of the "C" programming language. A pseudo-code implementation for one embodiment of premultiplier 430 for long-block transforms may be as given in the following Code Example 1.

CODE EXAMPLE 1

```
for (p=0; p<N/2; p++)
{
Z[p]=((x[2p]-x[2N-2p-1])-(x[N+2p]+x[N-1-2p])-j(x
  [2p]+x[2N-1-2p]+(x[N+2p]-x[N-1-2p]))*(cos(2π/
  (16N)*(8p+1))-j sin(2π/(16N)*(8p+1)));
}
```

Here p is the variable in the output sequence Z[p], j is the imaginary unit, N=256, and the x[n] are the windowed input samples. Note that the output sequence Z[p] has N/2=128 complex-valued elements.

A pseudo-code implementation of one embodiment of premultiplier 430 for short-block transforms may be as given in the following Code Example 2. In one embodiment of the present invention, premultiplier 430 operates simultaneously on both the first short-block and the second short-block, generating output sequences Z1 [p] corresponding to the first short-block and Z2 [p] corresponding to the second short-block.

CODE EXAMPLE 2

```
for (p=0; p<N/4; p++)
{
Z1[p]=((x[2p]-x[N-1-2p])+j(x[N/2-1-2p]-x[N/2+2p]-
  x[N/2+2p]))*(cos(2π/(8N)*(8p+1))-j sin(2π/(8N)*
  (8p+1)));
Z2[p]=(0-(x[N/2+2p+N]+x[N/2-1-2p+N])-j(x[2p+N]+
  x[N-1-2p+N]))*(cos(2π/(8N)*(8p+1))-j sin(2π/(8N)*
  (8p+1)));
}
```

Again p is the variable in the output sequences Z1 [p] and Z2 [p], j is the imaginary unit, N=256, and the x[n] are the windowed input samples. It is noteworthy that subsequences Z1[m] and Z2[m] each contain 64 ($4^3$) elements, making each subsequence eligible to be transformed by a radix-4 FFT.

Once premultiplier 430 has changed the input sequence x[n] into Z[p], the Z[p] are transformed by DFT 440. In the case of long-block transforms, DFT 440 transforms the 128 elements of Z[p] into 128 elements of intermediate sequence z[q]. In the case of short-block transforms, DFT 440 transforms the 64 elements of Z1[p] into 64 elements of z1[q], and transforms the 64 elements of Z2[p] into 64 elements of z2[q].

A pseudo-code implementation of one embodiment of DFT 440 for long-block transforms may be as given in the following Code Example 3.

CODE EXAMPLE 3

```
for(q=0; q<N/2; q++)
{
  z[q]=0;
  for(p=0; p<N/2; p++)
  {
    z[q]+=Z[p]*(cos(2πpq/(N/2))-j sin(2πpq/(N/2)));
  }
}.
```

Here p is the variable in the complex-valued input sequence Z[p], q is the variable in the complex-valued output sequence z[q], N 256, and j is the imaginary unit. It may be useful to express real and imaginary parts of z[q] as z[q]= $z_r$[q]+j$z_i$[q].

A pseudo-code implementation of one embodiment of DFT 440 for short-block transforms may be as given in the following Code Example 4. In one embodiment of the present invention, DFT 440 operates simultaneously on both the first short-block and the second short-block, generating output sequences z1[q] corresponding to the first short-block and z2[q] corresponding to the second short-block.

CODE EXAMPLE 4

```
for(q=0; q<N/4; q++)
{
  z1[q]=z2 [q]=0;
  for (p=0; p<N/4; p++)
  {
    z1[q]+=Z1[p]*(cos(2πpq/(N/4))-j sin(2πpq/(N/4)));
    z2[q]+=Z2[p]*(cos(2πpq/(N/4))-j sin(2πpq/(N/4)));
  }
}.
```

Again p is the variable in the complex-valued input sequence Z[p], q is the variable in the complex-valued output sequence z[q], N=256, and j is the imaginary unit.

In the FIG. 4 embodiment, once DFT 440 has changed the input sequence Z[p] into z[q], the postmultiplier 450 acts upon the z[q]. In the case of long-block transforms, postmultiplier 450 converts the 128 elements of z[q] into 128 elements of complex-valued sequence y[k]. The real and imaginary parts of the elements of y[k] are separated and shuffled to yield the 256 elements of real-valued final output sequence $X_D$[k]. In the case of short-block transforms, postmultiplier 450 converts the 64 elements of z1[q] into 64 elements of complex-valued sequence y1[k], and transforms the 64 elements of z2[q] into 64 elements of complex-valued sequence y2[k]. The real and imaginary parts of y1[k] are separated and shuffled to yield the 128 elements of real-valued final-output sequence $X_D$[k]: the real and imaginary parts of y2[k] are separated and shuffled to yield the 128 elements of real-valued final output sequence $X2_D$[k].

A pseudo-code implementation of one embodiment of postmultiplier 450 for long-block transforms may be as given in the following Code Example 5.

CODE EXAMPLE 5

```
for(k=0; k<N/2; k++)
{
  y[k]=(-1)^{k}/(√2)*z[k]*(cos(2π/(16N)*(8k +1))-j sin
    (2π/(16N)*(8k+1)));
}
```

Here k is the variable in the output sequence y[k], N=256, and j is the imaginary unit.

The real-valued final output sequence $X_D$[k] is derived from separating and shuffling the real and imaginary parts of complex-valued sequence y[k], where y[k]=$y_r$[k]+j$y_i$[k]. For even values of k, $X_D$[k]=$y_r$[k/2]. For odd values of k, $X_D$[k]=$y_i$[N/2-1-(k-1)/2].

A pseudo-code implementation of one embodiment of postmultiplier 450 for short-block transforms may be as given in the following Code Example 6. In one embodiment of the present invention, postmultiplier 450 operates simultaneously on both the first short-block and the second short-block, generating output sequences $X1_D[k]$ corresponding to the first short-block and $X2_D[k]$ corresponding to the second short-block.

CODE EXAMPLE 6

```
for(k=0; k<N/2; k++)
{
  y1[k]=z1[k]*(cos(2π/(8N)*(8k+1))−j sin(2π/(8N)*
    (8k+1)));
  y2[k]=z2[k]*(cos(2π/(8N)*(8k+1))−j sin(2π/(8N)*
    (8k+1)));
}
```

Again k is the variable in the complex valued output sequences y1[k] and y2[k], N=256, and j is the imaginary unit.

The real-valued final output sequence $X1_D[k]$ is derived from the real and imaginary parts of complex-valued sequence y1[k], where $y1[k]=y1_r[k]+jy1_i[k]$. For even values of k, $X1_D[k]=y1_r[k/2]$. For odd values of k, $X1_D[k]=y1_i[N/4-1-(k-1)/2$. Similarly, the real-valued final output sequence $X2_D[k]$ is derived from the real and imaginary parts of complex-valued sequence y2[k], where $y2[k]=y2_r[k]+jy2_i[k]$. For even values of k, $X2_D[k]=y2_r[k/2]$. For odd values of k, $X2_D[k]=y2_i[N/4-1-(k-1)/2]$.

The real-valued final output sequences $X_D[k]$ produced by the FIG. 4 embodiment correspond to the $X_D[k]$ which could have been calculated directly using Equation 1A and Equation 1B (from the AC-3 standard) above.

Figure 4B:
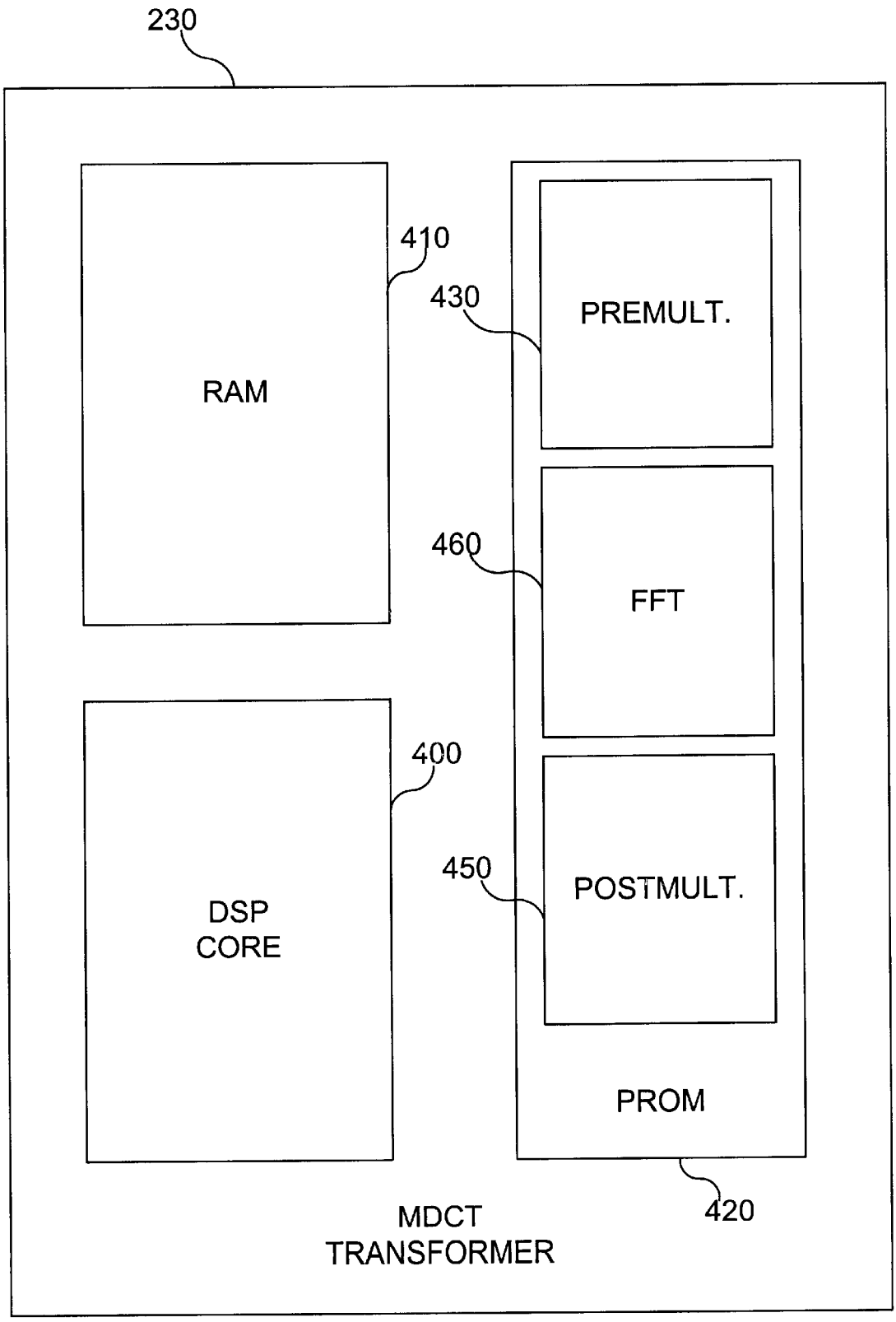
FIG. 4B is a block diagram for an alternate embodiment of the modified discrete cosine transformer of FIG. 2, in accordance with the present invention.

Referring now to FIG. 4B, a block diagram for an alternate embodiment of the MDCT transformer 230 of FIG. 2 is shown, in accordance with the present invention. In the FIG. 4B embodiment of the present invention, the discrete Fourier transform (DFT) of Code Example 3 and Code Example 4 may be replaced by a fast Fourier transform (FFT). (The term FFT refers collectively to a series of efficient algorithms for computing discrete Fourier transforms first widely promulgated by J. W. Cooley and J. W. Tukey.) When the DFT is replace by an FFT, the computational complexity of the MDCT calculation may be reduced from $O(N^2)$ to $O(N\log_2 N)$.

The efficient FFT algorithms for computing the DFT operate by breaking the computation into smaller DFT computations. This breaking into smaller computations is the basic principle that underlies all FFT algorithms. For a 64-point (which equals $2^6$ or $4^3$) computation of the DFT, the computation may be broken into either 6 stages of 2-point DFT computations, or 3 stages of 4-point DFT computations. The computation with 6 stages of 2-point DFT computations is called a radix-2 FFT algorithm. The computation with 3 stages of 4-point DFT computations is called a radix-4 FFT algorithm. In the present invention, radix-4 FFT algorithms are preferred due to their lower computational complexity when compared with radix-2 FFT algorithms. Generally, the higher the radix, the more the effects of symmetry can be exploited in the FFT. For the reasons of symmetry, and fewer stages of computation, a radix-4 FFT is more efficient than a radix-2 FFT.

In the FIG. 4B embodiment of the present invention, DFT 440 may be replaced by FFT 460. Recall that for TDAC the transform block lengths are either 512 ($2^9$) for a long transform or 256 ($2^8=4^4$) for a short transform. In the FIG. 4B embodiment of the present invention, premultiplier 430 acts upon the incoming digital audio samples x[n] and converts them to a new sequence Z[p]. The sequence Z[p] contains 128 samples for a long-block transform. Because $128=2\times4^3$, the sequence Z[p] may be transformed by a radix-2 transform cascaded upon a pair of radix-4 transforms. A pair of subsequences Z1[p] and Z2[p] for a short-block transform each contain 64 samples. Because $64=4^3$, a more efficient radix-4 FFT may be performed on the sequences Z1[p] and Z2[p] in the short-block transforms.

A pseudo-code implementation of one embodiment of FFT 460 for long-block transforms may be as given in the following Code Example 7. It is noteworthy that the function FFT_radix4_128 of Code Example 7 utilizes a radix-2 FFT cascaded into a pair of radix-4 FFT's by calling function FFT_radix4_64 two times. An exemplary implementation of function FFT_radix4_64 is given below in Code Example 8.

CODE EXAMPLE 7

```
/** 128 point FFT **/
void FFT_radix4_128( )
{
    long x[2], y[2];
    long X[2], Y[2];
    adr0 = 0;
    adr2 = 64;
    /** radix 2 transform **/
    for(j = 0; j < 2; j++)
    {
        for(i = 0; i < 32; i++)
            {
              x[0] = R[adr0]; y[0] = I[adr0];
              x[1] = R[adr2]; y[1] = I[adr2];
              Wx = cos(2*pi*i*j/128);
              Wy = sin(2*pi*i*j/128);
              X[0] = (R[adr0] + R[adr2])/2;
              Y[0] = (I[adr0] + I[adr2])/2;
              X[1] = (R[adr0] − R[adr2])/2 * Wx − (Y[adr0] −
              Y[adr1])/2 * Wy;
              Y[1] = (R[adr0] − R[adr2])/2 * Wy + (Y[adr0] −
              Y[adr1])/2 * Wx;
                R[adr0] = X[0];
                I[adr0] = Y[0];
                R[adr2] = X[1];
                I[adr2] = Y[1];
                adr0++;
                adr2++;
            }
        }
    /** a pair of 64-point FFT **/
    FFT_radix4_64(0, 16, 0);
    FFT_radix4_64(64, 16, 0);
}
where R[i] = real part of Z[i]
          I[i] = imaginary part of Z[i]
          i = 0, 1, . . . N/2-1
```

A pseudo-code implementation of one embodiment of FFT 460 for short-block transforms may be as given in the following Code Example 8. In the Code Example 8 embodiment, the arguments of function FFT_radix4_64 are directions to arrays which contain the input data.

CODE EXAMPLE 8

```
/** 64-point FFT **/
void FFT_radix4_64(short adr0_par, short off0_par, short adr3_par)
{
  long x[4], y[4];
  long X[4], Y[4];
  /** interface **/
  adr0 = adr0_par;        /* adr0 = 0 or 64 */
```

-continued

```
  off0 = off0_par;          /* off0 = 16        */
  mod1 = 1;
  for(k = 0; k < 3; k++)          /* stage loop   */
    {
        off1 = off0 * 2;
        for(j = 0; j < mod1; j++)  /* group loop: 1, 4, 16        */
        {
          for(i = 0 ; i < off0; i++)   /* butterfly loop        */
            {
              x[0] = R[adr0+off0*0]; y[0] = I[adr0+off0*0];
              x[1] = R[adr0+off0*1]; y[1] = I[adr0+off0*1];
              x[2] = R[adr0+off0*2]; y[2] = I[adr0+off0*2];
              x[3] = R[adr0+off0*3]; y[3] = I[adr0+off0*3];
              fft4(&x, &y, &X, &Y);        /* Radix-4 butterfly **/
              R[adr0+off0*0] = X[0]; I[adr0+off0*0] = Y[0];
              R[adr0+off0*1] = X[1]; I[adr0+off0*1] = Y[1];
              R[adr0+off0*2] = X[2]; I[adr0+off0*2] = Y[2];
              R[adr0+off0*3] = X[3]; I[adr0+off0*3] = Y[3];
              adr0 += 1;
            }
            adr0 += off1;
            adr0 += off0;
        }
          if(k < 2)
            {
              for(m=0; m < mod1; m++)   /* mod1: 1 4 */
              {
                for(n=0; n < off0; n++)    /* off0: 16 4 */
                  {
                    for(i=0; i<4; i++)
                    {
                    (R[adr1+i*off0+n] + j*I[adr1+i*off0+n]) =
                      (R[adr1+i*off0+n] + j*I[adr1+i*off0+n]) *
                      (cos(2*pi*(i*n)/64) +
                        j sin(2*pi*(i*n/64));
                    }
                  }
              adr1 += mod1*off0;
            }
        }
      mod1 = mod1 * 4;
      off0 = off0 / 4;
    }
}
/** radix-4 butterfly **/
void fft4(long *x, long *y, long *X, long *Y)
{
  /** real part **/
  *X    = (*x + *(x+1) + *(x+2) + *(x+3))/4;
  *(X+1) = (*x + *(y+1) - *(x+2) - *(y+3))/4;
  *(X+2) = (*x - *(x+1) + *(x+2) - *(x+3))/4;
  *(X+3) = (*x - *(y+1) - *(x+2) + *(y+3))/4;
  /** imag part **/
  *Y     = (*y + *(y+1) + *(y+2) + *(y+3))/4;
  *(Y+1) = (*y - *(x+1) - *(y+2) + *(x+3))/4;
  *(Y+2) = (*y - *(y+1) + *(y+2) - *(y+3))/4;
  *(Y+3) = (*y + *(x+1) - *(y+2) - *(x+3))/4;
}
```

Figure 5:
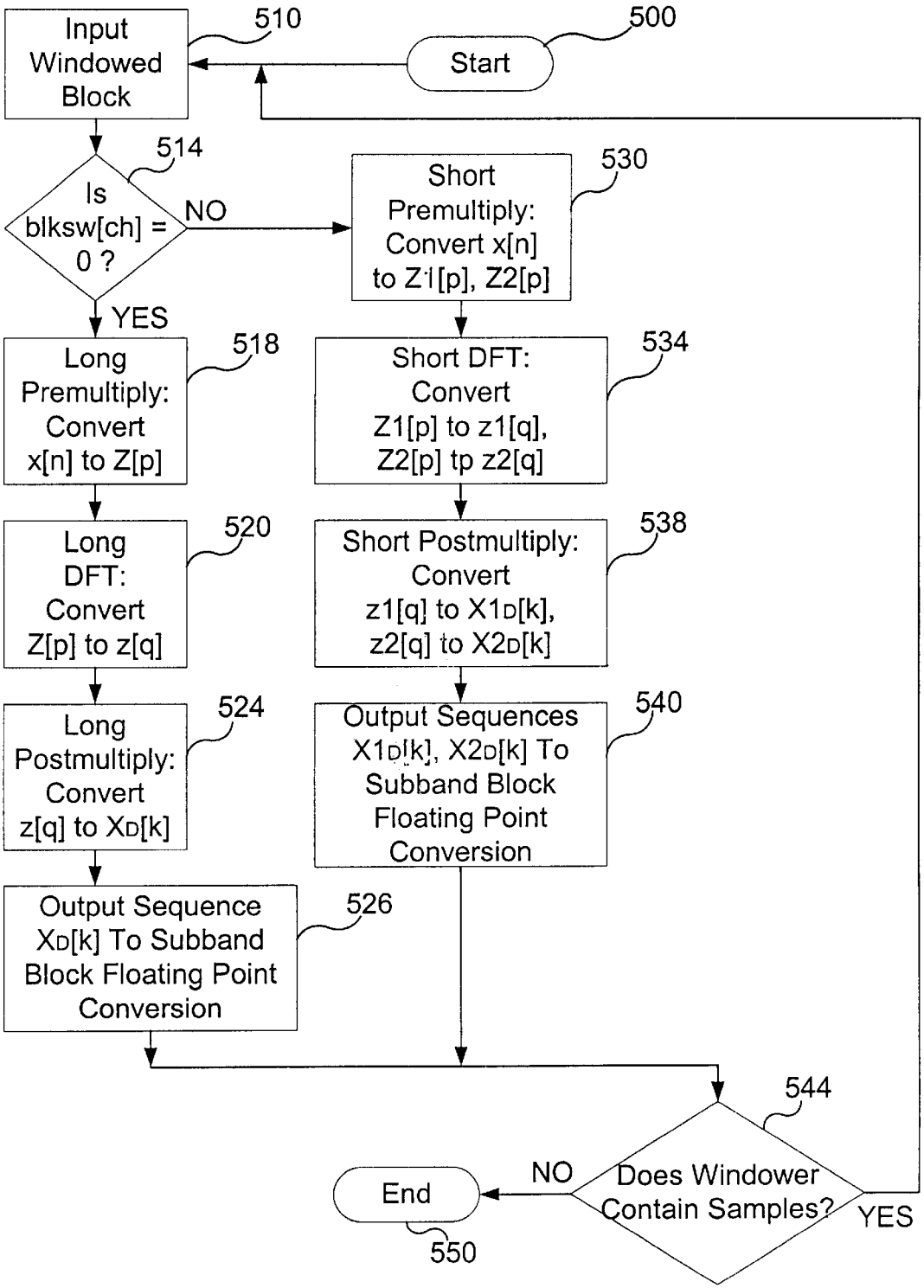
FIG. 5 is a flowchart of method steps for performing a modified discrete cosine transform, in accordance with the present invention.

Referring now to FIG. 5, a flowchart of method steps for performing a modified discrete cosine transform is shown, in accordance with the present invention. In the FIG. 5 method, windower 228 periodically sends windowed blocks of digital audio samples from audio channel ch to MDCT transformer 230. Block size controller 224 determines the value contained within blksw[ch] flag for audio channel ch. At the time the initial block of digital audio samples from channel ch is ready for transfer from windower 228 to MDCT transformer 230, the present process begins in step 500.

In step 510, MDCT transformer 230 receives a block of 512 digital audio samples from windower 228. MDCT transformer 230 then, in decision step 514, immediately checks the value contained within blksw[ch] flag. If the value of blksw[ch] is equal to 0, then MDCT transformer 230 performs a long-block transform. The long-block transform begins in step 518 with a long-block premultiply to convert input sequence x[n] into intermediate sequence Z[p]. Then, in step 520, MDCT transformer 230 performs a DFT to transform intermediate sequence Z[p] into intermediate sequence z[q]. Finally, in step 524, MDCT transformer 230 performs a long-block postmultiply to convert intermediate sequence z[q] into output sequence $X_D$[k].

MDCT transformer 230, in step 526, sends the resulting output sequence $X_D$[k] to subband block floating point converter 236. MDCT transformer 230 then determines, in step 544, whether further blocks of digital audio samples are in windower 228. If the answer is no, then MDCT transformer 230 stops processing in step 550. Conversely, if the answer is yes, then MDCT transformer 230 returns to step 510 to input another block of digital audio samples, and the FIG. 5 process repeats.

The foregoing description presumes that MDCT transformer 230, in decision step 514, determined that the value contained within blksw[ch] flag was equal to 0. If, conversely, the value of blksw[ch] flag is equal to 1, then in step 514 MDCT transformer 230 performs a pair of short-block transforms. The short-block transforms begin in step 530 with a short-block premultiply that converts input sequence x[n] into a pair of intermediate sequences Z1 [p] and Z2[p]. Then, in step 534, MDCT transformer 230 performs a bifurcated DFT to transform intermediate sequences Z1[p] and Z2[p] into intermediate sequences z1[q] and z2[q]. Finally, in step 538, MDCT transformer 230 performs a short-block postmultiply to convert intermediate sequences z1[q] and z2[q] into output sequence $X1_D$[k] and $X2_D$[k].

In step 540 MDCT transformer 230 sends the resulting output sequences $X1_D$[k] and $X2_D$[k] to subband block floating point converter 236. MBCT transformer 230 then determines, in step 544, whether further blocks of digital audio samples are present in windower 228. If the answer is no, then MDCT transformer 230 stops processing in step 550. Conversely, if the answer is yes, then MDCT transformer 230 returns to step 510 to input another block of digital audio samples, and the FIG. 5 process repeats.

The invention has been explained above with reference to one embodiment. Other embodiments will be apparent to those skilled in the art in light of this disclosure. For example, the present invention may readily be implemented using configurations and techniques other than those described in the embodiment above. Additionally, the present invention may effectively be used in conjunction with systems other than the one described above in one embodiment. Therefore, these and other variations upon the disclosed embodiments are intended to be covered by the present invention, which is limited only by the appended claims.

What is claimed is:

1. A method for providing transformations, comprising the steps of:

premultiplying input data sequences to generate first intermediate sequences using a premultiplier, said input data sequences including long blocks of input data samples, said long blocks containing 512 units of said input data samples, said first intermediate sequences containing 128 premultiplied data samples, said premultiplier including means for computing said first intermediate sequences from said input data sequences;

performing discrete Fourier transform transformations on said first intermediate sequences to generate second intermediate sequences using a discrete Fourier transform; and postmultiplying said second intermediate sequences to generate output data sequences using a postmultiplier, said output data sequences being modified discrete cosine transforms of said input data sequences.

2. The method of claim 1, wherein said means for computing said first intermediate sequences includes the step of calculating elements Z[p] of said first intermediate sequences from elements x[n] of said input data sequences by setting $$Z[p]=((x[2p]-x[2N-2p-1])-(x[N+2p]+x[N-1-2p])-j(x[2p]+x[2N-1-2p]+(x[N+2p]-x[N-1-2p]))*(\cos(2\pi/(16N)*(8p+1))-j\sin(2\pi/(16N)*(8p+1))),$$

where n is a variable for said input data sequences, p is a variable for said first intermediate sequences, j is an imaginary unit, and N equals 256.

3. The method of claim 2, wherein said discrete Fourier transform includes the step of calculating elements z[q] of said second intermediate sequence from said elements Z[p] by the summation $$z[q]+=Z[p]*(\cos(2\pi pq/(N/2))-j\sin(2\pi pq/(N/2))),$$

where q is a variable for said second intermediate sequences, and said p ranges in value from 0 to N/2.

4. The method of claim 2, wherein said discrete Fourier transform is a fast Fourier transform.

5. The method of claim 4, wherein said fast Fourier transform is a radix-2 fast Fourier transform cascaded upon a pair of radix-4 fast Fourier transforms.

6. A method for providing transformations, comprising the steps of:

premultiplying input data sequences to generate first intermediate sequences using a premultiplier, said input data sequences including short blocks of input data samples, said short blocks containing 256 units of said input data samples, said first intermediate sequences containing 64 premultiplied data samples, said premultiplier including means for computing said first intermediate sequences from said input data sequences; said means for computing said first intermediate sequences including the step of calculating elements Z1[p] of said first intermediate sequences from elements x[n] of said input data sequences by setting $$Z1[p]=((x[2p]-x[N-1-2p])+j(x[N/2-1-2p]-x[N/2+2p]-x[N/2+2p]))*(\cos(2\pi/(8N)*(8p+1))-j\sin(2\pi/(8N)*(8p+1)));$$

and the step of calculating elements Z2[p] of said first intermediate sequences from said elements x[n]by setting $$Z2[p]=(0-(x[N/2+2p+N]+x[N/2-1-2p+N])-j(x[2p+N]+x[N-1-2p+N]))(\cos(2\pi/(8N)*(8p+1))-j\sin(2\pi/(8N)*(8p+1))),$$

where n is a variable for said input data sequences, p is a variable for said first intermediate sequences, j is an imaginary unit, and N equals 256;

performing discrete Fourier transform transformations on said first intermediate sequences to generate second intermediate sequences using a discrete Fourier transform; and postmultiplying said second intermediate sequences to generate output data sequences using a postmultiplier, said output data sequences being modified discrete cosine transforms of said input data sequences.

7. The method of claim 6, wherein said discrete Fourier transform includes the step of calculating elements z1[q] of said second intermediate sequences from said elements Z1[p] by the summation $$z1[q]+=Z1[p]*(\cos(2\pi pq/(N/2))-j\sin(2\pi pq/(N/2)));$$

and the step of calculating elements z2[q] of said second intermediate sequences from said elements Z2[p] by the summation $$z2[q]+=Z2[p]*(\cos(2\pi pq/(N/2))-j\sin(2\pi pq/(N/2)))$$

where q is a variable for said second intermediate sequences, and where said p ranges in value from 0 to N/4.

8. The method of claim 6, wherein said discrete Fourier transform is a fast Fourier transform.

9. The method of claim 8, wherein said fast Fourier transform is a radix-4 fast Fourier transform.

* * * * *